United States Patent [19]

Badolato

[11] 4,358,177

[45] Nov. 9, 1982

[54] STRAIN RELIEF CLAMP AND ASSEMBLY

[75] Inventor: James A. Badolato, Sidney, N.Y.

[73] Assignee: The Bendix Corporation, Southfield, Mich.

[21] Appl. No.: 160,898

[22] Filed: Jun. 19, 1980

[51] Int. Cl.[3] ..... H01R 13/58

[52] U.S. Cl. ..... 339/103 M

[58] Field of Search ..... 339/103 R, 103 M, 105

[56] References Cited

U.S. PATENT DOCUMENTS

| | | | |
|---|---|---|---|
| 3,004,236 | 10/1961 | Dickenson et al. | 339/103 M |
| 3,054,081 | 9/1962 | Bertram et al. | 339/103 M |
| 3,718,889 | 2/1973 | Bartlett | 339/103 R |
| 3,854,787 | 12/1974 | Snyder | 339/103 R |
| 3,907,396 | 9/1975 | Huber | 339/103 R |
| 4,192,571 | 3/1980 | Strautz | 339/103 M |

FOREIGN PATENT DOCUMENTS

| | | | |
|---|---|---|---|
| 7222088 | 6/1972 | Fed. Rep. of Germany . | |
| 47-22149 | 6/1972 | Japan | 339/103 M |

*Primary Examiner*—Joseph H. McGlynn

*Attorney, Agent, or Firm*—Charles D. Lacina; Raymond J. Eifler

[57] ABSTRACT

Strain relief apparatus for a plurality of discrete side-by-side cables (60) terminating in a matable electrical connector (10) housing (11) disposing a like plurality of contacts in a generally linear array or parallel side-by-side relation with each terminated wire extending axially rearwardly therefrom. The strain relief apparatus includes a pair of U-shaped channels (30, 40) having confrontable medial bight portions for clasping plates (36, 46) provided with aligned sets of apertures (37, 47) and coated with a deformable plastic material (55), the medial bight portions when brought into confronting relation and compressed together about the rearwardly extending wires passing therebetween rigidly secures an axial portion of each of the wires and prevents forces from deflecting the wires. A pair of stand-off support brackets (20) securingly spaces each of the channels axially rearward from the connector entry face (14).

2 Claims, 3 Drawing Figures

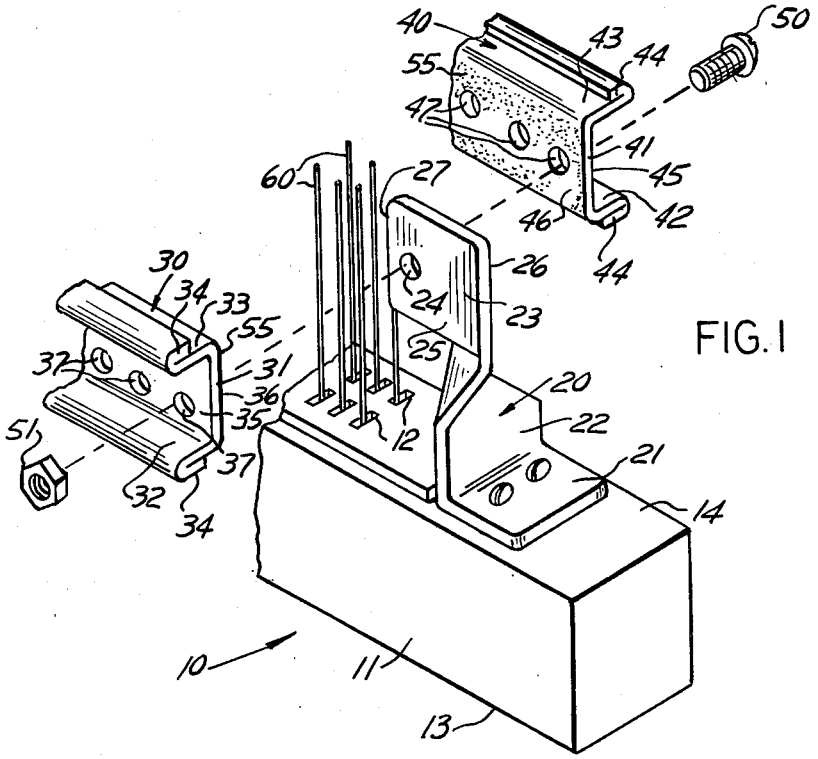
FIG. 1
FIG. 3
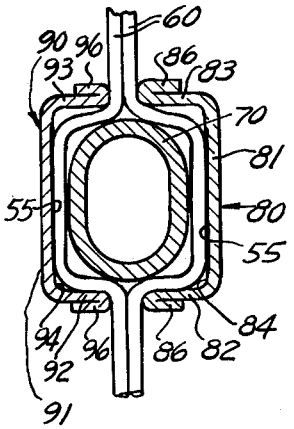
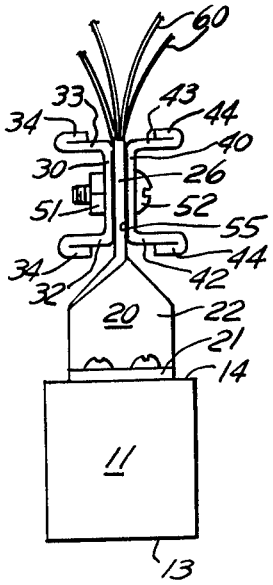
FIG. 2

STRAIN RELIEF CLAMP AND ASSEMBLY

The present invention relates to generally rectangular multi-contact connectors having a plurality of terminated wires extending outwardly and rearwardly therefrom in parllel side-by-side relation and more particularly to strain relief apparatus spaced axially rearwardly of the connector for limiting radial and axial movement of the wires.

BACKGROUND OF THE INVENTION

An electrical connector assembly generally includes matable plug and receptacle members, each member including a housing of insulative (or dielectric) material having cavities within which electrical contacts of conductive material are retained. In these assemblies, the contacts are electrically terminated to a wire which extends rearwardly/outwardly from the respective cavity. Were no restraint means to be provided to the wires, soldered or other conductor terminations would be constantly vulnerable to interruption by stresses resulting from both radial and axial forces placed on the wires. To safeguard against such separation of wire conductors from their associated contacts, a number of strain relief devices have been provided in the past.

In cylindrical-shaped connectors having a primary axis, the terminated wire positions are radially clustered fairly closely together about the connector axis. To prevent loose wire movement from injuring the electrical termination, the loose wires are typically bunched together and tightly secured into a bundle by a cable tie. Bundling, however, forces the wires to deflect radially from their axes and places both axial and lateral loads on the electrical termination. One solution disclosed by U.S. Pat. Application S.N. 16,719 registered the contact cavities with apertures in a rigid disc spaced axially rearwardly of the connector member and passed each terminated wire through the respective aperture. While suitable for the purpose of eliminating radial wire deflection, this apparatus would not necessarily eliminate the effect of axial forces. As the number of contacts employed in a connector increases, so does the minimum force to disengage the connector as well as a likelihood that a user in the field will pull on the wires to assist in disengagement of the connector. Accordingly, a more desirable apparatus would restrain a terminated wire from both radial and axial movement.

The electronics industry is tending more and more towards circuitry being printed and/or components used therewith being arranged on a generally rectangular shaped board with electrical interconnection locations being spaced along one or more edges of the board. Accordingly, a suitable connector must advantageously space a plurality of discrete contacts in a parallel, side-by-side relation. As the board length and the number of interconnection points on the board increases, linear separation between a connector's outermost wire connection points would also increase thereby resulting in the wires not being clustered closely together. In such a case, if each of the discrete wires were to be bundled together, radial wire deflection would place undue strains on the wire/contact termination. Further, during disengagement, a user would again have a natural tendency to want to tug on the plurality of wires and axially strain the wire terminations.

Unrestrained wires undergo lateral deflection just due to their weight. This would be true whether flat (ribbon) cable or discrete wires were utilized. When these wires pass through a moisture sealing grommet passage, lateral deflection of the wires could deflect the grommet passage, allowing moisture to enter the passage and short out a circuit.

Simple cable clamps are known. However, by exerting clamping pressure on opposite sides of a cable, problems have developed in the past, such as a shorting of conductors with the clamping means. Plastic ribbon conductors, for example, are typically embedded in polyethelene-terephthalate, a material subject to pressure called cold flow. As a result, either during assembly or after installation, a high risk is presented that the clamping pressure will cause an extrusion of the plastic cable insulation from a conductor or conductors with a concomitant shorting of the conductors with the clamp.

Accordingly, it would be desirable to provide apparatus that secures a plurality of wires terminated to contacts in spaced apart substantially side-by-side relation, that prevents both radial and axial deflection of the terminated wires, that eliminates or reduces forces acting on the electrical termination and that prevents lateral wire movement from deflecting a grommet passage and thereby allow moisture to enter the connector assembly and short out the contact-to-wire termination.

DISCLOSURE OF THE INVENTION

Accordingly, to eliminate deleterious effects that radial forces have on moisture sealing due to bending of the wires and that radial and/or axial forces have on contact-to-wire terminations, a strain relief apparatus is provided. In particular, this invention is directed to providing a strain relief apparatus for a rectangular shaped connector housing 11 which disposes a plurality of contacts in side-by-side linearly spaced arrays, a portion of the strain relief apparatus being spaced axially rearwardly of the housing and adapted to restrain a portion of each of a plurality of terminated wires 60 motionless against both axial and radial influences.

In one embodiment according to this invention, the strain relief apparatus comprises a pair of stand-off support brackets 20 and a pair of generally U-shaped channels 30,40, each bracket having one end 21 thereof mounted to one distal end of the connector housing and the other end 23 secured to each like end of the U-shaped channels, each channel including a medial bight portion or clasping plate 31,41 and a pair of webs upstanding therefrom. Each clasping plate exterior surface 36,46 is adapted to be in confronting relation and each is coated with a portion of deformable plastic 55. A set of apertures 37,47 are spaced in side-by-side relation across the medial bight portion of each channel, each set of apertures, when aligned, being adapted to receive a bolt 50 therethrough, the bolt being secured thereto by a nut 51. Use of one or more nut/bolts laterally across the channels permits selective local and/or uniform compression to be achieved about the wires. After the channels have been brought into confronting relation and the wires passed between the channels, the medial bight portions of each channel are clasped together to deformably compress the wires into the plastic.

One important advantage of the present invention is the provision of strain relief for a multi-contact rectangular connector having the plurality of wires spaced side-by-side across the body which prevents both radial and axial motion of the wires.

Another advantage of the invention is the provision of a clamping bracket which provides a user with means to adjust local compression force about one or more of a plurality of separate laterally spaced-apart wires.

A further advantage is provision of strain relief apparatus which can be secured rearwardly from a rectangular connector to axially restain and hold motionless a plurality of wires extending from the connector.

A still further advantage is the provision in a multicontact rectangular connector of a clamp which laterally distributes and secures the plurality of discrete wires extending from the contacts.

Yet another advantage is the provision of deformable means in a strain relief apparatus which allows a plurality of individual connector wires to be compressed into their own unique securement groove.

The above and other advantages and features of the invention will become apparent from the following detailed description taken in conjunction with the accompanying drawings and claims which form a part of this specification. Further, the use of numerals is for the purpose of clarification only and is not intended to limit the specific structure illustrated.

BRIEF DESCRIPTION OF THE DRAWINGS

FIG. 1 is an exploded perspective view of a matable rectangular connector having a strain relief apparatus according to the invention.

FIG. 2 is an end view of the rectangular connector of FIG. 1 shown assembled.

FIG. 3 is a sectional view of an alternate strain relief apparatus according to this invention.

DETAILED DESCRIPTION OF THE INVENTION

Referring now the drawings, FIG. 1 illustrates an elongated rectangular connector 10 including a housing 11 of insulative dielectric material provided with a plurality of cavities 12 oriented in a linear array extending between opposite lateral ends of the housing and extending between a front mating face 13 and a rear entry face 14. Each of the cavities are adapted to mount therein one of a plurality of matable electrical contacts (not shown) for mating and each of the contacts are terminated to a discrete wire 60. Each of the discrete wires 60 extend axially rearwardly and outwardly from the rear entry face 14.

A pair of stand-off support brackets 20 (only one being shown) are mounted proximate to opposite lateral end portions of the housing. As shown, bracket 20 is mounted onto the rear entry face 14 and arranged to extend substantially perpendicularly therefrom. Each stand-off bracket 20 includes a support foot 21 secured to the rear entry face 14, a "flag-like" flange 23 having a leading edge 27 and a medial body portion 22 connecting the support foot to the flange, the flange being twisted 90° relative to the body portion 22 and having flange surfaces 25,26 provided with an aperture 24 extending therethrough. Each of the brackets are identical and are mounted on the opposite lateral end portions of the connector housing such that the leading edges 27 are directed inwardly and facing one another.

A pair of longitudinally extending generally U-shaped channels 30, 40 are adapted to be secured to the flanges. Each channel 30,40 includes, respectively, a medial bight portion 31,41 and a pair of webs 32, 33 and 42, 43 upstanding therefrom. Each web includes a folded over portion 34,44 to increase the stiffness of the channel and prevent the channel section from warping or laterally buckling under loading. The medial bight portions 31,41 define wire clasping plates having respectively an interior surface 35,45, an exterior surface 36,46 and first and second sets of apertures 37,47 extending between the plate surfaces, each of the sets being disposed along a line in spaced apart relation and each being adapted to be in alignment when the exterior surfaces of the medial bight portions are placed in confronting relation. Respective apertures at lateral ends of each set are aligned to provide the channels a securable portion with the two flange apertures 23, each of the apertures being sized to receive fastener means, such as shown by a bolt 50 and a nut 51.

Preferably, each of the remaining aligned pairs of apertures of each set of spaced apart apertures are also adapted to receive like tightenable nuts/bolts. Use of such additional fastener members allows a user with a selective felxibility of either locally or uniformly increasing the compressive force laterally imposed on the wires between the ends of the channels. Also, since the U-shaped channels can be provided in any length and since the set of holes can advantageously be uniformly spaced, unwanted lengths can be cut off and the user can substitute channels for use on any rectangular connector of a shorter length. In some applications, nonuniform aperture spacing may be desirable.

Preferably and in accord with one embodiment the present invention, the medial bight or clasping plate of each channel adapted to be compressed about the wires is coated with a deformable material 55, such as vinyl polymer, a vinyl latex coating or a modified polyacrilac latex. One suitable polyacrilac latex is "Hycar Latex" 2600-X-84 and manufactured by a division of B.F. Goodrich. The latex coating is chosen to be pliant but deformable when a wire is pressed thereagainst. This coating of plastic material provides a surface having increased resistance to axial sliding to an insulative jacket or wire. Compression of the axial wire portion into the deformable material forms a unique securement groove or trough for the discrete wire portion.

FIG. 2 shows an end view of a completed connector assembly with the plurality of discrete wires 60 being axially restrained and secured from laterally bending about their axis. A ribbon cable would equally be rigidly secured.

Each of the U-shaped channels 30,40 are secured to opposite flange faces 25,26 of flanges 23 of the stand-off brackets 20 with their confrontable exterior surfaces 36,46 compressed against the wires 60. As shown by the assembly, the two channels are generally longitudinally uniform in transverse cross-section and define in combination a generally I-shaped cross-section. Each of the U-shaped channels include a longitudinal section modulus and a pair of transverse section moduli. When the channels are secured to form the I-shape, the two transverse moduli provide a combined transverse section modulus resistant to both bending and torsion about the longitudinal axis when the wires disposed therebetween are subject to removal forces.

Although the flange 23 is shown sandwiched between the confrontable exterior surfaces of the clasping plates, it may be desirable in some circumstances to have the flange disposed against one of the channel interior surfaces 35,45, thereby eliminating any minimum set-off between the confrontable surfaces as would be defined by the flange thickness. Further it may be desirable in some applications to eliminate th ewebs and use a pair of apertured clamping plates having one of their surfaces coated with the deformable material.

FIG. 3 is an alternate embodiment according to the present invention. A pair of uniform in cross-section longitudinally extending generally U-shaped channels 80,90 include respectively middle portions 81, 91 and web portions 82,92 and 83,93 upstanding therefrom, the upstanding webs and the respective interior surfaces 84,94 of the middle portions facing one another. The middle portions are provided with apertures (not shown) at their outermost lateral ends, these apertures being adapted to align with the flange apertures 23. Folded over portions 86,96 on the webs increase the rigidity stiffness and of the channels to transverse forces acting on the wires secured therebetween. An elongated cylindrical tube 70 is disposed between the interior surfaces 84,94 of the channels 80, 90 when the middle portions are in confronting relation, the opposite lateral ends of the tube being spaced inwardly of the outermost channel apertures. The interior surfaces 84,94 would be coated with one of the suitable deformable plastic coatings 55 as described above. These coatings deform when the wires are compressed thereagainst by the tube outer surface when the channels are brought into confronting relation and secured to the stand-off brackets. In an assembly, the plurality of discrete wires 60 are passed between the U-shaped channels 80,90 with some of the wires 60 being directed around one side of the tube 70 and other of the wires 60 being directed around the other side of the tube 70. Each of the channels are secured together at their ends and to the brackets by a nut/bolt passed through the channel apertures when aligned with the bracket 20 apertures 23. The tube is captivated between the channels so secured.

While there have been described what are at present considered to be the preferred embodiment of the invention, it will be understood that various modifications may be made therein, and it is intended to cover in the appended claims all such modifications as fall within the true spirit and scope of the invention.

I claim:

1. In combination with an electrical connector of the type including a housing having a mating face and a wire entry face, a plurality of mateable electrical contacts disposed in an array in the housing and a plurality of conductive wires terminating at respective contacts proximate the wire entry face, improved strain relief comprising:

restraining means for securing an axial portion of the terminated wires in a transverse spaced apart relationship to the connector housing, the restraining means comprising:

a generally cylindrical tube shaped member;

a pair of U-shaped channels, each of said channels including a medial bight portion and a pair of upstanding webs, said tube being captivated by said channels such that some of the wires are directed around one side of the tube and other of the wires are directed around the other side of the tube; and means for compressively mounting said tube within said U-shaped channels; and means for supporting said restraining means axially rearwardly of said wire entry face whereby axial and lateral loads placed on wire terminations are eliminated.

2. An electrical connector as recited in claim 1 wherein said means for supporting the restaining means includes a pair of laterally separated stand-off brackets disposed on the rear entry face of said housing.

* * * * *